United States Patent [19]

Kuroda

[11] Patent Number: 4,496,029

[45] Date of Patent: Jan. 29, 1985

[54] SCAFFOLD PLANK

[76] Inventor: Shigeharu Kuroda, No. 1-13, Tomigaoka 5-chome, Nara, Japan

[21] Appl. No.: 480,452

[22] Filed: Mar. 30, 1983

[51] Int. Cl.[3] ..... E04G 5/08

[52] U.S. Cl. ..... 182/222; 182/46; 182/119

[58] Field of Search ..... 182/222, 223, 119, 179, 182/178, 46

[56] References Cited

U.S. PATENT DOCUMENTS

| | | | |
|---|---|---|---|
| 2,485,165 | 10/1949 | Pollman | 182/223 |
| 3,434,567 | 3/1969 | Wilkins | 182/222 |
| 3,556,254 | 6/1969 | Lambert | 182/223 |
| 3,565,212 | 11/1969 | Johnson | 182/222 |
| 3,726,362 | 4/1973 | Puckett | 182/178 |
| 3,997,027 | 12/1976 | Patterson | 182/46 |

FOREIGN PATENT DOCUMENTS

| | | | |
|---|---|---|---|
| 2457945 | 1/1981 | France | 182/222 |
| 2501267 | 9/1982 | France | 182/222 |
| 307467 | 2/1967 | Japan . | |
| 125172 | 1/1972 | Japan . | |
| 121777 | 1/1977 | Japan . | |
| 2115480 | 6/1980 | Japan . | |
| 536347 | 5/1941 | United Kingdom | 182/222 |
| 1487302 | 9/1977 | United Kingdom | 182/46 |
| 2013764 | 8/1979 | United Kingdom | 182/222 |

*Primary Examiner*—Reinaldo P. Machado
*Attorney, Agent, or Firm*—Birch, Stewart, Kolasch & Birch

[57] ABSTRACT

A scaffold plank comprising a layer or layers of covering member wrapping a plurality of hollow, lightweight elongated members rectangular in cross section and arranged in side-by-side contact to provide at each end a plurality of transversely aligned opening mouths into which a corresponding number of inwardly projecting plug portions of a transverse end member are matingly fit, whereby plank ends are protected from deformation, damage, and incoming of mud or water. The plurality of elongated members may be replaced by a single piece of partitioned tubular member which is a rectangular in cross section and has two or more opening mouths formed respectively at opposite end thereof.

20 Claims, 11 Drawing Figures

SCAFFOLD PLANK

BACKGROUND AND SUMMARY OF THE INVENTION

The present invention relates to a scaffold plank for providing a supporting floor or walkway platform for workers.

The scaffold planks are commonly used, for example, in construction and repair industries. The scaffolod planks are, when in use, mounted on a scaffolding frame erected at a work site to form the walkway platform as disclosed, for example, in U.S. Pat. No. 3,726,362 to Puckett and U.S. Pat No. 3,565,212 to Johnson.

Typical conventional scaffold planks are made of wood as disclosed, for example, in the above referred U.S. Pat. No. 3,726,362. However, the wooden scaffold plank is generally not so reliable from the viewpoint of safety and durability. When the wooden plank gets wet, it becomes slippery (dangerous) and heavy (inconvenient in transportation). In addition, it becomes easily weakened when repeatedly exposed to rains.

Another typical conventional scaffold planks are made of metal as disclosed, for example, in Japanese Utility Model Publication No. 3074/67 (Application No. 10193/64, filed Feb. 14, 1964) and U.S. Pat. No. 3,556,254 to Lambert. The former has proposed a steel-made scaffold plank coated with synthetic resin layer, which is heavy due to its nature and inconvenient in practical use. The latter has proposed a telescopical scaffold plank made of lightweight durable sheet metal such as aluminium. The telescopical structure may be convenient in transportation and storage, but expensive to manufacture and dangerous when the plank in use is unexpectedly retracted. Further, a worker may trip against a stepped portion inevitably formed at every joint portion of adjacent telescopical members forming a walkway surface. Furthermore, at a work site for construction or the like, clumps of fresh concrete frequently stick to and become hardened on the metal surface of the plank, resulting in corrosion by alkali content thereof. Still further, it is not very easy to remove clumps of hardened concrete stuck on the metal surface of the plank, because the fresh concrete can adhere much better to the metal surface as compared to the wooden surface of the synthetic resinous surface.

Other conventional scaffold planks are basically made of synthetic resin and reinforced with rigid materials. One model of such planks is disclosed in Japanese Utility Model Publication No. 1251/72 (Application No. 29634/68, filed Apr. 12, 1968), in which a scaffold plank has a rigid skeleton entirely wrapped with a FRP layer, the skeleton being composed of a lightweight core, formed of foamed plastics or made of reinforced paper tube, and a FRP layer enclosing the core. However, this type of plank has proved to be rather expensive to manufacture, and not very sufficient in flexural strength unless the plank is considerably thick.

Other models of the plastic plank have been proposed by the Applicant himself of the present invention, as disclosed in Japanese Patent Publication Nos. 1217/77 (Application No. 98537/70, filed Nov. 9, 1970) and 21154/80 (Application No. 98538/70, filed Nov. 9, 1970), wherein a plurality of reinforcements such as pipes are embedded in a plastic plank body. However, these prior inventions of the Applicant have such disadvantages that the end portions of the plank are easily damaged or deformed when the plank falls down against the ground or collides against something, and that muddy water, rain water or other are permitted to come into the pipes through the opening mouths thereof, adding weight and inviting corrosion.

Accordingly, it is a general object of the present invention to eliminate the above discussed disadvantages inherent to the prior art scaffold planks.

Another object of the invention is to provide an improved scaffoled plank which is light in weight, inexpensive and easy to manufacture, sufficient in flexural strength and rigidity, and good in appearance.

A further object of the invention is to provide an improved scaffold plank which is protected from corrosion, deformation and damage at the ends of the plank, and incoming of mud, water and other foreign matters.

A still further object of the invention is to provide an improved scaffold plank which permits easy removal of clumps of hardened concrete sticking to the outer surface thereof.

In order to fulfill the above objects and advantageous features, the scaffold plank according to the present invention includes a plurality of lightweight square hollow elongated members transversely aligned in side-by-side contact or otherwise a single piece of partitioned square tubular member, which provides lightweight and sufficient flexural strength and rigidity, and permits manufacture at a relatively low cost.

The plank of the invention further includes a covering member or members, preferably formed of synthetic resinous material, which provides good and colorful appearance and permits easy removal of clumps of hardened concrete sticking to the outer surface of the plank.

The plank of the invention further includes a pair of end members mounted to the opposite ends of the plank, by which deformation and/or damage at the plank ends can be prevented and also mud, water and other undesirable foreign matters are hindered from coming into the hollow elongated members. Each of the end members has a plurality of plug portions which are transversely aligned in spaced-apart relation and inwardly project into mating engagement with a corresponding number of opening mouths of the transversely aligned hollow elongated members, whereby the aligned hollow elongated members are tightly assembled to promote flexural strength and rigidity. The end member can be easily replaced, when damaged. Thus, the plank can enjoy a long span of life.

By optional provision of a pair of specifically constructed reinforcing members to be interposed between the end member and the aligned hollow elongated members, the strength and rigidity, and hence durability, can be more enhanced.

Further, the covering member and the end members, both made of non-corrosive materials, cooperate to protect the plank from corrosion. The whole structure of the plank according to the present invention is relatively simple and mass-producible.

Other objects, features and advantages of the present invention will become apparent from the detailed description given hereinafter; it shoud be understood, however, that the detailed description and specific examples, while indicating preferred embodiments of the invention, are given by way of illustration only, since various changes and modifications within the spirit and scope of the invention will become obvious to those skilled in the art from this detailed description.

DESCRIPTION OF THE PREFERRED EMBODIMENTS

Figure 1:
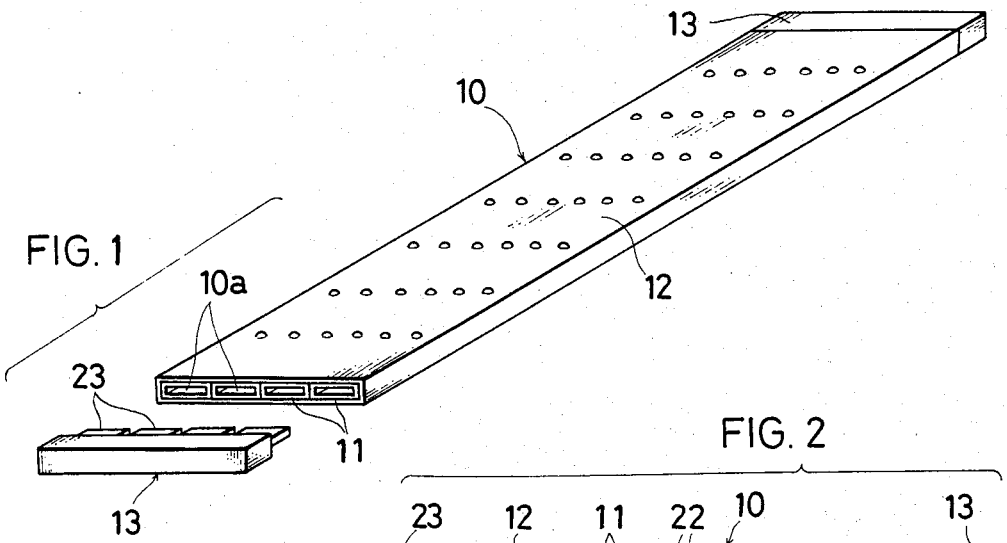
FIG. 1 is an exploded perspective view of a scaffold plank embodying the present invention.
Figure 2:
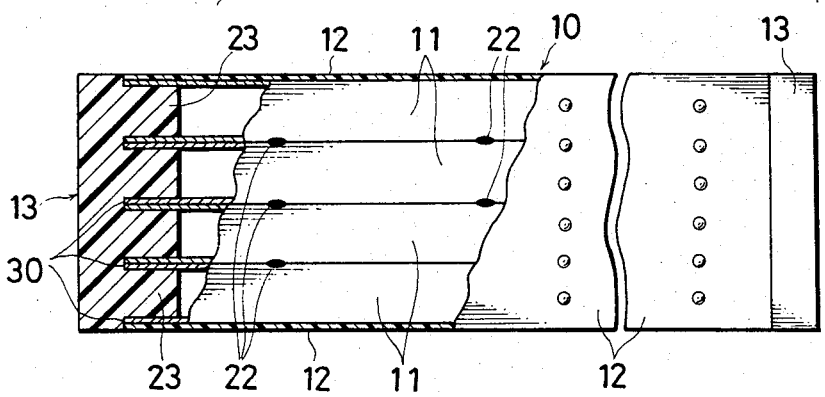
FIG. 2 is a partially sectional and partially cutaway top plan view of the plank of FIG. 1.

Referring now to the accompanying drawings, wherein like reference numerals designate like or corresponding elements throughout different views, FIGS. 1 and 2 illustrate a scaffold plank 10 according to the present invention.

In general, the plank 10 is approximately 100 to 600 cm, preferably about 200 to 400 cm in length; approximately 10 to 100 cm, preferably about 30 to 50 cm in width; and approximately 10 to 30 mm, preferably about 15 to 25 mm in thickness. However, it will be easily understood that these dimensions may be varied as desired.

The plank 10 may preferably include a plurality of hollow elongated members 11 arranged in side-by-side contact and wrapped with a covering member 12. Generally, the number of the hollow elongated members may be in the range of 2 to 10, and preferably 3 to 6. However, in a particular case as will be described hereinafter, a single piece of hollow, partitioned elongated member may be utilized.

Each of the plank ends is formed with a plurality of transversely aligned opening mouths 10*a* and covered with a transverse end member 13 serving as a plank end protector and also as a connector for the elongated members.

In general, each of the hollow elongated members is substantially rectangular in cross section including a pair of opposed vertical side walls. Each of the elongated members is about 10 to 20 cm, preferably about 6 to 12 cm in width; and approximately 10 to 50 mm, preferably about 15 to 25 mm in thickness. However, these dimensions may also be varied as desired. The longitudinal length of the hollow elongated member may substantially correspond to that of the covering member 12.

Square tubes made of metal, preferably aluminium or its alloy whose wall thickness is in the range of 0.8 to 2.0 mm, preferably 1.0 to 1.5 mm, may preferably be utilized as the hollow elongated members. However, it is also possible to utilize square tubes made of other materials, such as reinforced plastics or reinforced paper.

Each of the hollow elongated members 11 illustrated in FIG. 1 is simply square in cross section. However, the configuration of the cross section of the hollow elongated members may be varied in many ways. Several typical examples of the modified configuration of the cross section ae illustrated in FIGS. 3 to 7.

Figure 3:
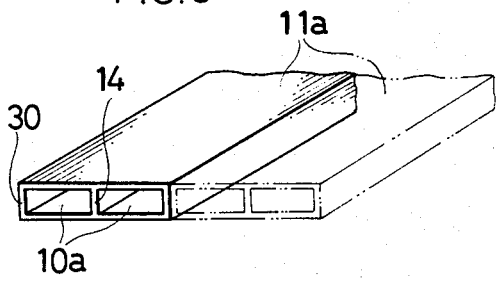
FIGS. 3 thru 7 are enlarged fragmentary perspective views showing several modifications of hollow elongated members which may be substituted for those in FIGS. 1 and 2.

In FIG. 3, there is illustrated a square-tubular elongated member 11*a* which has a partition 14 serving as a reinforcing rib. It is obvious that two or more partitions 14 may be provided, if desired. It is also obvious that a single piece of square-tubular elongated member having one or more reinforcing partitions, similar to the partitions 14, may be employed instead of a plurality of hollow elongated members arranged in side-by-side contact.

Figure 4:
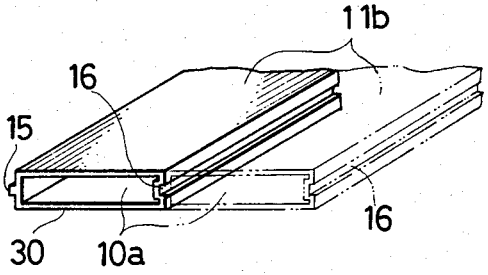

FIG. 4 illustrates another example of the configuration, wherein a square-tubular member 11*b* has a male element, for example a substantially horizontally projecting longitudinal rib 15 formed on its one vertical side wall, and a corresponding female element, for example a longitudinal groove 16 formed in the other vertical side wall thereof. When in use, the male element 15 of one member 11*b* (shown in phantom lines in the illustration) is matingly engaged with the female element 16 of the adjacent member 11*b* (shown in solid lines in the illustration).

Figure 5:
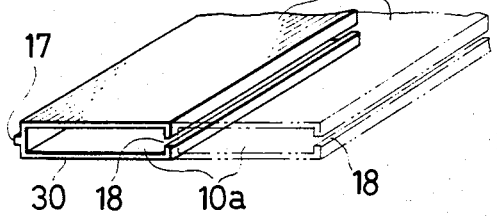

FIG. 5 illustrates a further example of the configuration, wherein one vertical side wall of a square tubular member 11*c* is formed with a longitudinal rib 17, similar to the rib 15 of FIG. 4, while the opposite vertical side wall thereof is formed with a longitudinal slit 18. When in use, the rib 17 of one member 11*c* (shown in phantom line) is in matingly engagement with the slit 18 of the adjacent member 11*c* (shown in solid lines).

Figure 6:
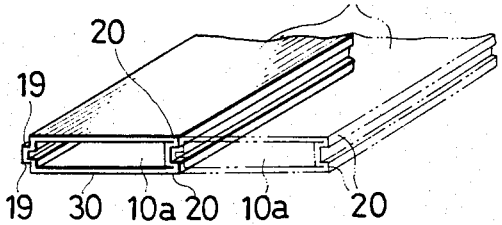

FIG. 6 illustrates a still further example of the configuration, in which a pair of vertically opposed corners of one vertical side wall of a square tubular member 11*d* are formed with a pair of longitudinal shoulders 19, while a pair of vertically opposed corners of the other vertical side wall thereof are formed with a pair of longitudial corner ribs 20 which can be engageably seated on the shoulders 19. If desired, one of the shoulders 19 and one of the ribs 20 located on the same side may be omitted.

Figure 7:
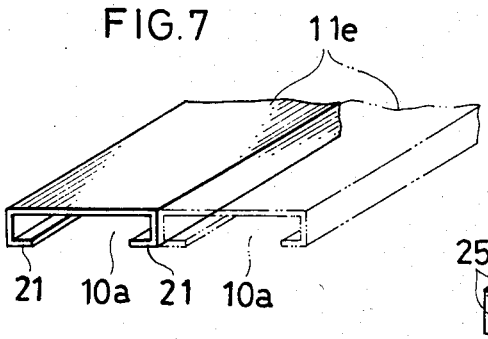

FIG. 7 illustrates a further example of the configuration, in which the hollow elongated member is in the form of a channel-shaped metallic member 11*e* having a pair of inwardly bent legs 21.

It should be noted that any one of the hollow elongated members 11*c*, 11*c*, 11*d* and 11*e* may also be provided with one or more suitable reinforcing elements for example, reinforcing partitions similar to the partitions 14 as described in connection with FIG. 3. The configuration of the cross section of each of the elongated members may be selected as desired, in order to meet the required conditions such as weight for portability, strength against maximum load, dimension for scaffolding frames, and manufacturing cost for commercialization.

When in use, a selected number of the hollow elongated members (any one of the members 11, 11*a*, 11*b*, 11*c*, 11*d* or 11*e*) are arranged in side-by-side contact and connected together by a suitable connecting method known per se. For instance, in the case where the hollow elongated members are made of metal, they may preferably be connected together by spot-weldings at 22 in FIG. 2. While, in the case where the hollow elongated members are made of plastic tubes, they may be connected together by heat-bondings substantially in the similar manner to that shown in FIG. 2. On the other hand, in the case where the hollow elongated members are reinforced paper tubes, they may be connected together by means of suitable adhesives. Suitable adhesives may be additionally utilized as auxiliary connecting means for the metalic or plastic hollow elongated members.

The covering member 12 for enclosing a selected number of connected hollow elongated members may be made of plastic material such as, for example, polyethylene, polypropylene or other suitable material such as rubber. The covering member 12 can be coated onto the connected hollow elongated members for example by a known extrusion method.

The covering member 12 may be in the range of 0.5 to 5 mm, preferably 1 to 3 mm in wall thickness. However, these values may also be varied as desired. Further, the covering member may be utilized in two or more layers, if desired. The outer surface which forms a walkway platform for scaffolding may preferably be roughened for the known safety purpose.

Each of the opposite ends of the plank 10 is covered by the transverse end member 13 which has a plurality of transversely aligned in spaced-apart relation and inwardly projecting plug portions 23 and inner engaging walls 24 which are, when in use, in abutment with terminal edges or end walls 30 of the hollow elongated members. The number of the plug portions 23 may preferably be equal to that of the opening mouths of the plank 10. The configuration, arrangement on the end member 13, and dimension of each of the plug portions should be predetermined so that each of the plug portions 23 can matingly fit into the opening mouths 10*a* of the plank 10, as illustrated in FIGS. 1 and 2.

The end member 13 may be formed of such material as having good resistance to damage and deformation and good shock-absorbing properties, for example, plastics, rubber, wood or the like, preferably plastics and rubber.

In order to prevent the end member 13 from being unexpectedly removed from the plank 10, a suitable adhesive may preferably be utilized when the plug portions 23 are inserted into the opening mouths 10*a* of the plank 10. In the case where the covering member 12 has a tubular extension 12*a* (FIG. 9), the adhesive may also be applied between the internal wall of the extension 12*a* and the external walls 25 (FIG. 8) of the end member 13, for better connection therebetween.

Figure 9:
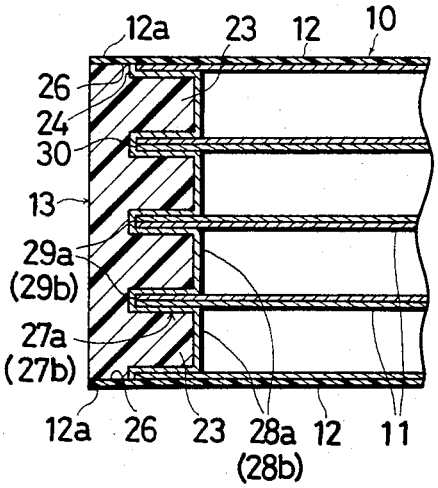
FIG. 9 is a sectional top plan view, with the reinforcing member incorporated in the plank.

In the case where the end member 13 is made of plastic material, the unexpected removal of the end member 13 from the plank 10 can be advantageously prevented by firmly connecting the member 13 to the extension 12*a* of the member 12, by heat-bondings at 26 in FIG. 9, with or without the above described adhesive applied between the extension 12*a* and the walls 25 of the end member 13.

The end member 13 may preferably be utilized in combination with a reinforcing member 27*a* or 27*b* (FIGS. 8 to 10) which is interposed between the end member 13 and the end portions of the connected hollow elongated members in order to prevent the end member 13 from being excessively pushed into the opening mouths 10*a* when external impact force is imposed thereon, for example at the time when the plank 10 falls down to the ground or collides with something. The reinforcing member also serves as a protector for preventing the end portions of the hollow elongated members from being deformed or damaged.

In general, the reinforcing member may be made of a rigid material, preferably metal or FRP(fiber-glass reinforced plastics), and has a plurality of plug-receiving sections and inner engaging walls which are, when in use, in abutment with the terminal edges or end walls 30 of the connected hollow elongated members.

Figure 8:
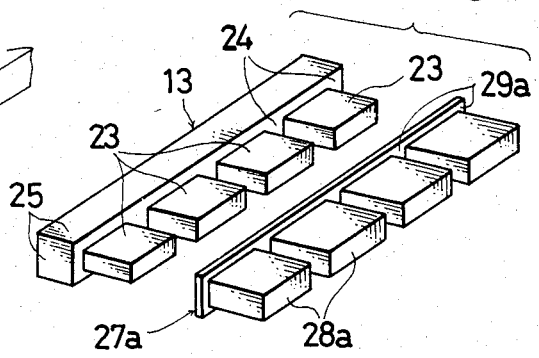
FIG. 8 is a perspective view showing one example of combination of an end member with a reinforcing member.

FIG. 8 illustrates one example of combination of the end member 13 and the cooperating reinforcing member 27*a* which has a plurality of transversely aligned in spaced-apart relation and inwardly protruding box-shaped plug-receiving sections 28*a* and inner engaging walls 29*a*. When in use, the plug portions 23 of the end member 13 are inserted into the box-shaped plug-receiving sections 28*a*, while the inner engaging walls 29*a* are in abutment with the terminal edges or end walls 30 of the connected hollow elongated members, as illustrated in FIG. 9. Thus, the end member 13 can be prevented from being excessively forced into the opening mouths 10*a* of the plank 10. In other words, the terminal edges 30 of the connected hollow elongated members are prevented by the reinforcing member 27*a* from undesirably eating into the body portion of the end member 13 to damage it.

Figure 10:
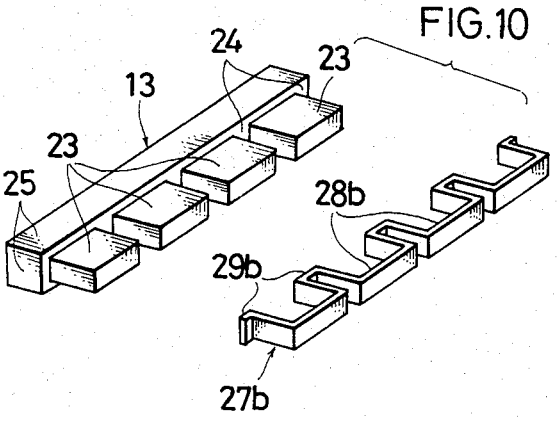
FIG. 10 is a similar view to FIG. 8, showing another example of combination of an end member with a modified reinforcing member.

FIG. 10 illustrates another example of combination of an end member 13 and a modified reinforcing member 27*b* which has a plurality of transversely aligned in spaced-apart relation and inwardly protruding channel-shaped plug-receiving sections 28*b* and inner engaging walls 29*b*. When in use, the plug portions 23 of the end member 13 are fit into the channel-shaped receiving sections 28*b*, while the inner engaging walls 29*b* are in abutment with the terminal edges 30 of the connected hollow elongated members 11 in the substantially same manner as illustrated in FIG. 9.

The reinforcing members 27*a*, 27*b* can be formed by a known press or other available machines.

It is to be noted that the end member 13 may be utilized without combination with the reinforcing member 27*a* or 27*b*. On the other hand, the reinforcing member itself may also be utilized independently without combination with the end member 13, if desired. In this instance, in the case where both of the reinforcing member and the hollow elongated members are made of metal, the former may preferably be spot-welded to the latter.

Figure 11:
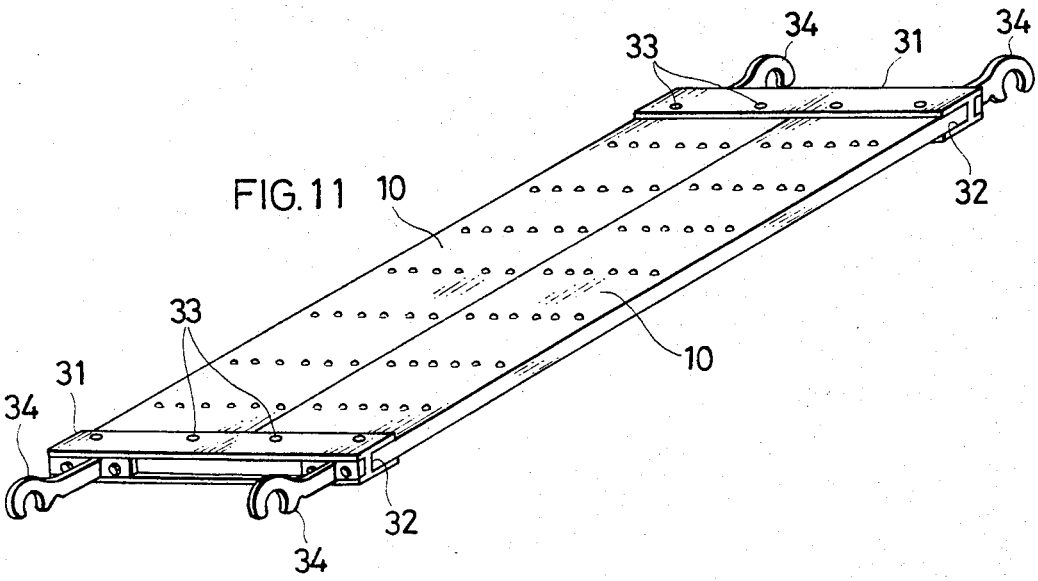
FIG. 11 is a perspective view showing a plurality of scaffold planks assembled together by end connectors in side-by-side contact to form a relatively wide walkway platform for scaffolding.

When in use, a single plank 10 provides a relatively narrow walkway platform for scaffolding. On the other hand, two or more planks 10 can be assembled together in side-by-side contact to provide a relatively wide walkway platform for scaffolding. For this purpose, a pair of end connectors 31 may be utilized as illustrated in FIG. 11. Each of the end connectors 31 is formed with a plank end receiving channel 32, a plurality of clamping bolts 33, and preferably a pair of hooks 34 by means of which the assembled planks 10 can be conveniently mounted on a structural beam of a scaffolding frame (not shown).

The present invention being thus described, it will be obvious that same may be varied in many ways. Such variations are not to be regarded as a departure from the spirit and scope of the invention, and all such modifications as would be obvious to those skilled in the art are intended to be included within the scope of the following claims.

I claim:

1. A scaffold plank which comprises a plurality of hollow elongated members arranged in side-by-side contact relationship to one another to provide a plurality of transversely aligned, opening mouths respectively at opposite ends of said plurality of hollow elongated members, each of said hollow elongated members being substantially rectangular in cross section, each of said hollow elongated members including a pair of opposed vertical side walls, at least one layer of covering member enclosing said plurality of hollow elongated members, a pair of end members serving as connectors mounted to said opposite ends of said plurality of hollow elongated members for maintaining said hollow elongated members in side-by-side contact relationship, each of said pair of end members including a plurality of plug portions which are transversely aligned in spaced-apart relation and inwardly project into mating engagement with said plurality of transversely aligned opening mouths, and each of said pair of end members further including inner engaging walls which are in abutment with end walls of said plurality of hollow elongated members.

2. The plank as defined in claim 1, which further comprises a pair of reinforcing members each of which is interposed between said end member and said plurality of hollow elongated members, each of said pair of reinforcing members having a plurality of plug receiving sections which are transversely aligned in spaced relation and inwardly protrude into mating engagement with said opening mouths of the hollow elongated members, each of said plug-receiving sections having an internal space into which one of said plug portions of the end member is fittingly received, and each of said pair of reinforcing members further having inner engaging walls which are in abutment with said end walls of said plurality of hollow elongated members.

3. The plank as defined in claim 2, wherein each of said plug-receiving setions is box-shaped.

4. The plank as defined in claim 2, wherein each of said plug-receiving sections is channel-shaped.

5. The plank as defined in claim 1, wherein said plurality of hollow elongated members are tubular members.

6. The plank as defined in claim 1, wherein said plurality of hollow elongated members are channel-shaped members.

7. The plank as defined in claim 1, wherein each of said plurality of hollow elongated members is formed with at least one reinforcing partition.

8. The plank as defined in claim 1, wherein each of said plurality of hollow elongated members has a male element projecting outwardly from one of said pair of vertical side walls, and a female element formed in another of said pair of vertical side walls.

9. The plank as defined in claim 8, wherein said male element is a substantially horizontally projecting longitudinal rib, and said female element is a longitudinal groove.

10. The plank as defined in claim 8, wherein said male element is a substantially horizontally projecting longitudinal rib, and said female element is a longitudinal slit.

11. The plank as defined in claim 1, wherein each of said hollow elongated members has at least one corner shoulder formed in one of said pair of vertical side walls, and at least one longitudinal corner rib formed on another of said pair of vertical side walls.

12. The plank as defined in claim 1, wherein said plurality of hollow elongated members are made of metal and connected together by spot-welding.

13. The plank as defined in claim 1, wherein said plurality of hollow elongated members are made of plastic material and connected together by heat-bonding.

14. The plank as defined in claim 1, wherein said plurality of hollow elongated members are reinforced paper tubes and connected together by adhesive.

15. The plank as defined in claim 1, wherein said covering member is longitudinally extended over said pair of end members and heat-bonded thereto.

16. A scaffold plank which comprises a single piece of hollow elongated member which is substantially rectangular in cross section;

said hollow elongated member is formed with at least one reinforcing partition to provide at least two transversely aligned opening mouths respectively at opposite ends thereof, at least one layer of covering member enclosing said hollow elongated member, a pair of end members mounted to said opposite ends of said hollow elongated member, each of said pair of end members including at least two plug portions which are transversely aligned in spaced-apart relation and inwardly project into mating engagement with said at least two transversely aligned opening mouths, each of said pair of end members further including inner engaging walls which are in abutment with end walls of said hollow elongated member, a pair of reinforcing members, each of which is interposed between said end member and said hollow elongated member, each of said pair of reinforcing members having at least two plug receiving sections which are transversely aligned in spaced-apart relation and inwardly protrude into fitting engagement with said at least two opening mouths of said hollow elongated member, each of said plug-receiving sections having an internal space into which one of said plug portions of the end member is fittingly received, and each of said pair of reinforcing members further having inner engaging walls which are in abutment with said end walls of said elongated tubular member.

17. The plank as defined in claim 16, wherein at least one of said pair of end members is replaced by said reinforcing member.

18. The plank as defined in claim 16, wherein each of said plug-receiving sections is box-shaped.

19. The plank as defined in claim 16, wherein each of said plug-receiving sections is channel-shaped.

20. The plank as defined in claim 16, wherein said covering member is longitudinally extended over said pair of end members and heat-bonded thereto.

* * * * *